US005813760A

United States Patent [19]

Strong

[11] Patent Number: 5,813,760

[45] **Date of Patent: *Sep. 29, 1998**

[54] RECIPROCATING MIX TANK AGITATOR AND PROCESS FOR MIXING THE LIQUID CONTENTS OF THE TANK

[75] Inventor: Christopher L. Strong, Littleton, Colo.

[73] Assignee: Binks Manufacturing Company, Franklin Park, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 736,572

[22] Filed: Oct. 24, 1996

[51] Int. Cl.[6] ..... B01F 11/00

[52] U.S. Cl. ..... 366/258; 366/332; 366/605

[58] Field of Search ..... 366/255–260, 366/332–335, 601, 348, 605

[56] References Cited

U.S. PATENT DOCUMENTS

| | | | |
|---|---|---|---|
| Re. 17,203 | 2/1929 | Fleek | 366/255 X |
| 215,857 | 5/1879 | Allegree | 366/258 |
| 258,658 | 5/1882 | Leavitt | 366/258 |
| 291,901 | 1/1884 | Henderson | 366/258 |
| 432,575 | 7/1890 | Socolofsky | 366/258 X |
| 742,823 | 11/1903 | Bashford | 366/332 |
| 912,279 | 2/1909 | Brockette | 366/256 X |
| 964,291 | 7/1910 | Mattern | 366/256 |
| 980,824 | 1/1911 | Noakes | 366/256 |
| 1,004,919 | 10/1911 | Sherman | 366/332 |
| 1,175,366 | 3/1916 | Lucas | 366/332 X |
| 1,337,362 | 4/1920 | Kennerly . | |
| 1,373,674 | 4/1921 | Rodger | 366/332 |
| 1,421,571 | 7/1922 | Rodger | 366/332 X |
| 1,489,956 | 4/1924 | Mason | 366/258 |
| 1,708,729 | 4/1929 | Klein | 366/258 |
| 1,768,765 | 7/1930 | Hogancamp | 366/258 |
| 1,881,361 | 10/1932 | Killman | 366/256 |
| 2,027,297 | 1/1936 | Tramposch . | |
| 2,780,444 | 2/1957 | Hickey . | |
| 3,073,577 | 1/1963 | Stevenson | 366/258 |
| 3,672,645 | 6/1972 | Terrels et al. . | |
| 3,767,535 | 10/1973 | Havewala et al. | 366/332 X |
| 4,151,792 | 5/1979 | Nearhood . | |
| 4,184,778 | 1/1980 | Terrels . | |
| 4,401,268 | 8/1983 | Pomponi, Jr. . | |
| 5,402,053 | 3/1995 | Divan et al. | 318/768 |
| 5,590,960 | 1/1997 | Clinton et al. | 366/136 X |

FOREIGN PATENT DOCUMENTS

| | | | |
|---|---|---|---|
| 59652 | 6/1954 | France | 366/260 |
| 3754 | 8/1912 | United Kingdom | 366/256 |

*Primary Examiner*—Charles E. Cooley
*Attorney, Agent, or Firm*—Wallenstein & Wagner, Ltd.

[57] ABSTRACT

An agitator for a paint mix tank is characterized by a paddle that has passages in it extending between opposite sides thereof and that is reciprocated up and down in the tank to keep the paint mixed and pigments and fillers in the paint in suspension. The paddle is reciprocated in the tank in linear directions generally along paths through its passages. Reciprocation is provided by a motor operating through a gearbox, and the speed of the motor is adjustable to control the reciprocation rate of the paddle. The passages through the paddle improve its agitation performance and enable its linear speed to be sufficiently low during agitation of the paint to eliminate foaming of and entrapment of air in the paint. A process is also dislosed for mixing the liquid contents of the tank without foaming and aeration by providing the above apparatus.

20 Claims, 1 Drawing Sheet

RECIPROCATING MIX TANK AGITATOR AND PROCESS FOR MIXING THE LIQUID CONTENTS OF THE TANK

BACKGROUND OF THE INVENTION

The present invention relates to paint agitators, and in particular to an improved paddle type agitator for a paint mix tank.

In spraying paint by means of paint spraying equipment and an associated paint supply tank, it is desirable to agitate the paint in the tank to prevent suspended pigments and fillers in the paint from settling out and to produce optimum mixing of the paint. The same is true in the spraying of various liquids other than paint, where agitation is required to effect and maintain proper mixing of the components of the liquids.

In automotive spray finishing operations, it is customary to have a paint supply comprising a number of relatively large paint mix tanks that contain selected colors of paints to be applied as coatings onto automotive bodies. The paint in each tank is delivered through a piping system to one or more stations where spraying apparatus may be selectively connected to the piping system for spraying a desired color of paint onto an automotive body. Such piping systems are normally of the recirculation type, with paint not utilized at a station being returned through the piping system to the paint mix tank from which it was drawn.

For an automotive paint to produce a fine finish, pigments and fillers in the paint must remain suspended. This is true for the paint throughout the entire recirculation system, which includes paint in both the piping system and paint mix tank. As long as the paint maintains a minimum fluid velocity, the pigments and fillers will remain agitated and mixed throughout the paint. Pumps for circulating the paint from and to the mix tanks through the piping system provide sufficient fluid pressure of the paint to maintain the necessary minimum velocity of the paint throughout the piping system. However, the pumps do not rapidly move the paint, and therefore cannot maintain mixing of the paint, in the paint mix tanks. Paint tank agitators are required for that purpose.

Traditional paint agitators incorporate rotating paddles to stir paint in a tank. However, a significant disadvantage of such agitators is that the rotating paddles cause a rolling wave on the surface of the paint, particularly as the paint level drops below the tops of the paddles. This rolling wave phenomenon, known as foaming, causes air entrapment in and aeration of the paint. Due to high paint viscosity, particularly the viscosity of waterborne paints as are now being extensively used in the automotive industry, air entrained in the paint does not escape before the paint enters the pump that provides delivery of paint to the spray stations and recirculation of paint through the piping system. As a result, air trapped in the paint produces a pressure drop of the paint as it enters the piping system, which results in a decreased velocity of the paint through the piping system and thereby a lesser degree of suspension of paint pigments and fillers. Also, having air in the paint produces very poor spray performance and degrades the coating applied onto automotive bodies. Reducing the rotation rate of the agitator paddles is a way to correct the problem of aerating the paint, but that can reduce mixing of paint in the tank to an unacceptable level.

A known type of paint agitator that utilizes a paddle, but in which the paddle is reciprocated rather than rotated, is disclosed in U.S. Pat. No. 4,401,268, assigned to the assignee of the present invention. The agitator of that patent comprises an imperforate paddle that is reciprocated up and down in paint in a paint cup of a hand held spray gun, and works well for the purpose. However, the paddle is relatively small even relative to a paint cup and would not be suitable for use in mixing paint in relatively large paint mix tanks as are normally encountered in automotive spray finishing operations. Even if the paddle were made larger for use with a large paint mix tank, such that its size relative to the tank were proportional to its size relative to a paint cup, it would still be too small to properly agitate the paint in the tank. Also, because the paddle of said patent is imperforate, its performance in a large tank would not provide the necessary agitation and mixing of the paint at a linear speed of reciprocation that would be slow enough to prevent aeration of the paint.

OBJECTS OF THE INVENTION

An object of the invention is to provide an agitator for effectively mixing liquid contents of a relatively large paint mix tank.

Another object is to provide such an agitator which includes a substantially flat perforated paddle extended into the paint mix tank.

A further object is to provide such an agitator wherein the paddle is coupled to a motor for being reciprocated at a rate determined by the operational speed of the motor.

SUMMARY OF THE INVENTION

In accordance with the present invention, there is provided an apparatus for agitating the liquid contents of a tank. The apparatus comprises an elongate shaft and an agitator paddle at a lower end of the shaft and having a plurality of passages extending therethrough between opposite sides thereof. The agitator paddle has a defined center region and perimeter such that the passages are disposed radially between locations proximate the center region and locations proximate the perimeter. Motor means coupled to an upper end of the shaft reciprocates the shaft and agitator paddle generally along paths through the passages. The agitator paddle is adapted to be extended on the shaft through an upper opening to the tank to mix liquid contents of the tank.

In one embodiment of the invention, the agitator paddle is generally flat and planar. In another embodiment, the agitator paddle is generally semispherical, an upper side of the agitator paddle is concave, and a lower side is convex.

The motor means may include an electric motor and a speed reduction means coupled to an output from the electric motor for converting a rotary output from the motor to a reduced speed rotary output from the speed reduction means. In this case the motor means further includes means coupled between the rotary output from the speed reduction means and the upper end of the shaft for converting the rotary output from the speed reduction means to a reciprocating output for reciprocating the shaft and agitator paddle. The means for converting may comprise a crank arm connected at one end to the rotary output from the speed reduction means and a connecting rod connected between an opposite end of the crank arm and the upper end of the shaft for reciprocating the shaft.

A cover is provided for closing the opening to the tank. The cover has a passage extending therethrough, and a linear bearing is on the cover and around the passage. The motor means is supported on the top of the cover and the shaft extends through the linear bearing and the passage in the cover to position the agitator paddle in the tank. The present invention also entails a process for mixing the liquid contents of the tank while at the same time avoiding the deleterious effects of foaming and aeration by providing an apparatus as summarized above and described further below.

The foregoing and other objects, advantages and features of the invention will become apparent upon a consideration of the following detailed description, when taken in conjunction with the accompanying drawings.

DETAILED DESCRIPTION

The present invention relates to an improved agitator for mixing the liquid contents of relatively large mix tanks, particularly relatively large paint mix tanks as are used in automotive spray finishing systems. In such systems, each of a number of paint mix tanks contains paint of a selected color. A pump for each tank moves paint from the tank through a piping system past spray paint stations where the paint can be withdrawn from the piping system for use, with paint not used at a station being returned through the piping system to the tank from which it was withdrawn. Such paint supply systems are often referred to as recirculation systems, and for an automotive paint to produce a fine finish, the pigments and fillers in the paint must remain suspended and uniformly dispersed. While paint of any particular color is being moved through its piping system, its pigments and fillers will remain agitated and dispersed as long as the paint maintains a minimum velocity through the piping system. However, a pump that moves paint through a piping system usually cannot itself maintain proper suspension of pigments and fillers in the paint within mix tank itself.

Paint agitators are therefore often employed to agitate paint in paint mix tanks. Conventionally, an agitator for a paint mix tank may comprise a rotary impeller, such as rotating paddles driven by a motor to stir paint in the tank. A disadvantage of such rotary agitators is that the rotating paddles cause a rolling wave on the surface of the paint, particularly as the level of paint in the mix tank falls below the top of the paddles. Such rolling wave phenomenon is known as foaming, and causes entrapment of air in and aeration of the paint. Due to high paint viscosity, particularly of waterborne paints that are now commonly used in the automotive industry, air entrained in the paint often does not escape before the paint is drawn into the pump and moved into and through the piping system. The air in the paint causes a large drop in pressure of the paint as it enters the piping system, which decreases the velocity of the paint through the piping system and promotes settling out of pigments and fillers. Also, air in the paint results in poor performance by the spraying equipment at the application stations. The problem of paint aeration can be reduced by slowing the rate of rotation of the agitator paddles, but that can reduce mixing of the paint to an unacceptable level.

Figure 1:
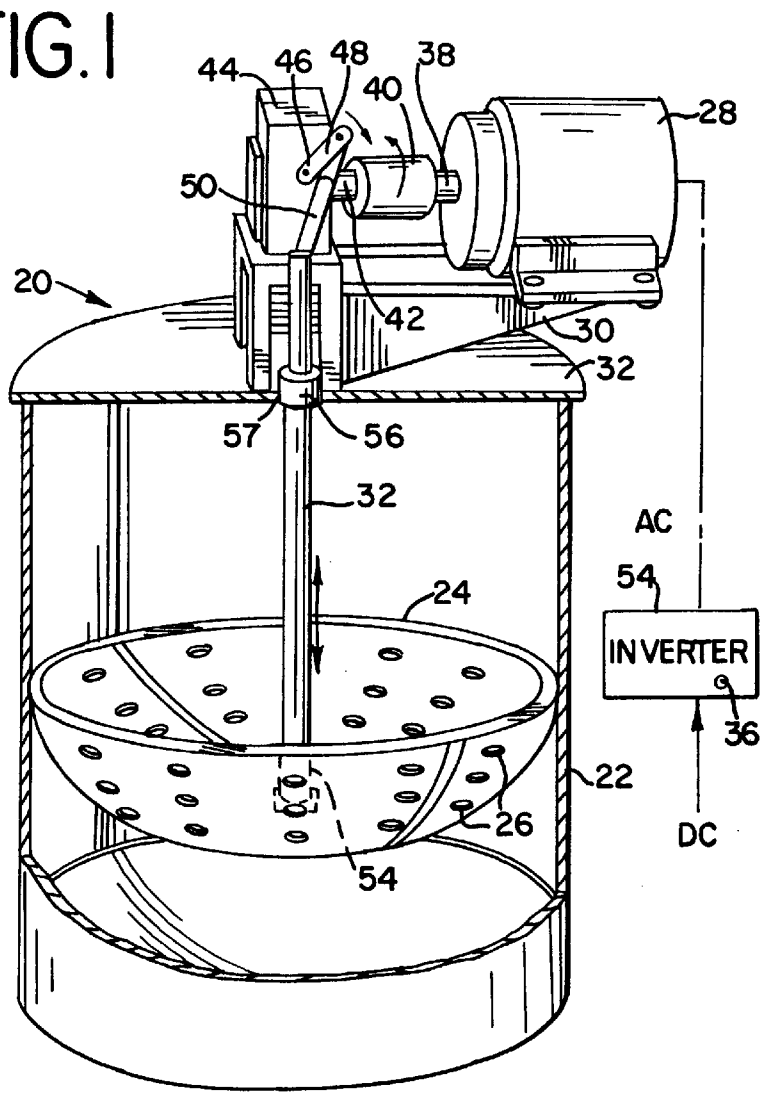
FIG. 1 is a side elevation view of a paint mix agitator having an agitator paddle configured according to one embodiment of the invention.

The present invention eliminates the problem of entrainment of air in paint in a paint mix tank as a result of agitating and mixing the paint. Referring to FIG. 1, there is indicated generally at 20 a paint agitator assembly according to one embodiment of the invention, for mixing paint contained in a paint mix tank 22, which may be a relatively large tank as used in automotive spray finishing operations. In this embodiment, the agitator comprises a relatively large paddle 24 that is reciprocated up and down in the paint. The paddle is provided with a plurality of passages, openings or apertures 26 extending between upper and lower surfaces thereof. The passages 26 are disposed radially between locations proximate a center region of the paddle 24 and locations proximate a perimeter of the paddle 24. The effectiveness of this method of agitation, i.e., of moving the apertured paddle up and down in the tank in directions along paths through the passages 26, is that proper agitation of the paint can be achieved with a speed of the paddle through the paint that is less than that which would otherwise be required if conventional rotating paddles were used. The result is an elimination of foaming of the paint in the tank and thereby of aeration of the paint, even when the level of paint drops below the paddle at the upper end of its agitation stroke.

The effectiveness of the paint agitator assembly 20 is due in part to the geometry of the paddle 24. The paddle is relatively large and advantageously of a diameter that is only slightly less than the inside diameter of the tank. The shape of the paddle can range from being similar in shape to the inside bottom of the mix tank to being flat, with the paddle 24 as shown having a generally semispherical shape. To ensure proper mixing of the entirety of the volume of paint in the mix tank 22, the extent of downward reciprocation of the paddle is such as to bring the paddle close to, and preferably within inches of, the bottom of the tank. The openings 26 in the paddle assist the agitation performance of the paddle by enabling movement of the paddle up and down through the paint in the tank without causing foaming of the paint, and by virtue of the turbulence and velocity imparted to the paint as it is forced to flow upwardly and downwardly through the openings with downward and upward reciprocation of the paddle.

Motor means is provided for reciprocating the apertured paddle 24 up and down in the paint mix tank 22. The motor means may comprise an electric induction motor 28 carried on a support 30. The support is mounted on a cover 32 that rests on and closes an opening to the upper end of the mix tank. An inverter 34 provides power to the motor. An input to the inverter is coupled to a d.c. voltage to develop at an output from the inverter an a.c. voltage that is applied to the induction motor. The inverter has a control knob 36 for adjusting the magnitude of the a.c. voltage to vary the speed of operation of the motor in order to control the selected reciprocation rate of the apertured paddle. To couple the induction motor to the paddle, a rotary output shaft 38 from the motor connects through a coupling 40 to a rotary input shaft 42 to a gearbox 44 that provides speed reduction to develop proper paddle driving forces and cycle rates. The gearbox has a rotary output shaft 46 that connects to an inner end of and carries a crank arm 48. An outer end of the crank arm is rotatably attached to one end of a connecting rod 50 and an opposite end of the connecting rod is rotatably attached to an upper end of a shaft 52. A lower end of the shaft is connected by a fastener 54 to the apertured paddle, whereby reciprocation of the shaft reciprocates the paddle. A linear bearing 56 is attached to the cover 32 in line with a passage 57 through the cover, and the shaft extends through the linear bearing and cover passage between the connecting rod and the paddle. The linear bearing guides the shaft during reciprocation and absorbs any side loads to which the shaft may be subjected. The cover closes the opening to the paint mix tank and prevents paint from escaping the tank.

In operation of the paint agitator assembly 20, a.c. power is delivered to the induction motor 28 through the inverter 34, energizing the motor and causing rotation of its output shaft 38. The motor output shaft operates through the coupling 40 to turn the input shaft 42 to the gearbox 44, which causes the gearbox output shaft 46 and crank arm 48 to turn at a reduced speed in accordance with a desired reciprocation rate of the apertured paddle 24. As the outer end of the crank arm rotates downward, it pushes the connecting rod 50 downward which, in turn, pushes the shaft 52 and apertured paddle downward. This continues until the outer end of the crank arm reaches the bottom of its rotation and begins moving upward, whereupon the crank arm pulls the connecting rod, shaft and agitator paddle upward. Upward movement of the paddle continues until the crank arm reaches the top of its rotation and begins to move downward once again, whereupon the cycle is repeated. Repetition of the cycle causes reciprocation of the apertured paddle in directions along paths through the paddle passages 26 to agitate paint in the mix tank 22. The extent of reciprocation of the paddle is determined by the length of the crank arm 48 and the particular rate of reciprocation by the setting of the inverter control knob 36.

Figure 2:
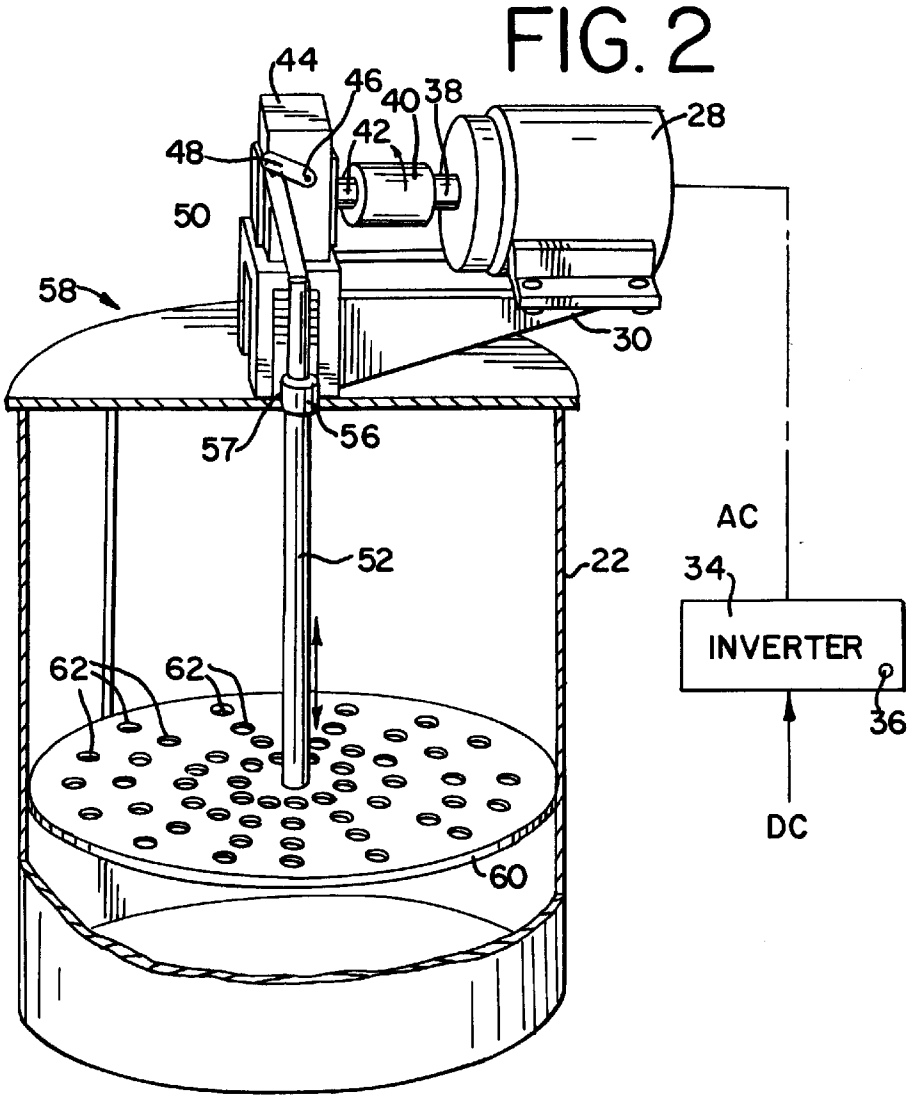
FIG. 2 is a side elevation view of a paint mix tank agitator having an agitator paddle configured according to another embodiment of the invention.

FIG. 2 shows an alternate embodiment of paint agitator assembly, indicated generally at 58. The difference between the apparatus of FIG. 2 and that of FIG. 1 resides in the configuration of the apertured agitating paddle. As compared with the generally semispherical agitator paddle 24 of FIG. 1, the agitator system of FIG. 2 uses a substantially flat circular paddle 60 through which a plurality of passages, openings or apertures 62 extend between upper and lower surfaces of the paddle. Similar to the embodiment shown in FIG. 1, the passages 62 are disposed radially between locations proximate a center region of the paddle 60 and locations proximate a perimeter of the paddle 60. As for the embodiment of FIG. 1, the paddle 60 has an outer diameter that is just slightly less than the inner diameter of the paint mix tank and is reciprocated in such manner as to closely approach the bottom of the tank. Except for the paddle 60, the paint agitator assembly 58 is the same as the paint agitator assembly 20, and like reference numerals have been used to denote like structure.

The paint agitator assemblies 20 and 58 are adapted to mount on top of and to close an upper opening to a paint mix tank, and can be adapted to all types of mix tanks, including those having dome tops. Also, although the present invention has been described as using an a.c. induction motor for the motor means, other types of motor means can be used. For example, air motors or hydraulic motors, or electrically driven ball or roller screws, may be utilized to drive an agitator paddle of an assembly.

While embodiments of the invention has been described in detail, various modifications and other embodiments thereof may be devised by one skilled in the art without departing from the spirit and scope of the invention, as defined in the appended claims.

What is claimed is:

1. A process for mixing the liquid contents of a tank without foaming and aeration comprising the steps of:

providing a shaft;

providing an agitator paddle at one end of said shaft having first and second sides, a center region, a perimeter, and a plurality of passages extending from the first side to the second side, wherein the passages are disposed radially between locations proximate the center region and locations proximate the perimeter;

providing a motor coupled to an opposite end of said shaft to reciprocate said agitator paddle in directions generally along paths through said passages, wherein said agitator paddle is adapted to be extended through an opening to the tank on the one end of said shaft, with the opposite end of said shaft being to the exterior of the tank;

and reciprocating said paddle at a sufficiently slow reciprocation rate to substantially prevent foaming and aeration of the liquid contents in the tank.

2. The process of claim 1 wherein said first and second sides of said agitator paddle are generally planar.

3. The process of claim 1 wherein said first and second sides of said agitator paddle have a generally semispherical profile.

4. The process of claim 3 wherein said first side is concave.

5. The process of claim 1 wherein said motor is an electric motor.

6. The process of claim 5 including coupling said motor to transmission means for converting a rotary output of said motor to a reduced speed rotary output and for converting said reduced speed rotary output to a reciprocating output of said shaft and agitator paddle.

7. The process of claim 6 including providing said transmission means with a crank arm connected at one end to said reduced speed rotary output, and providing a connecting rod connected between an opposite end of said crank arm and said shaft.

8. The process of claim 1, further including the step of providing a cover for an upper opening to the tank, said cover having a passage therethrough and a linear bearing communicating with said cover passage, wherein said motor is supported on said cover and said shaft extends through said linear bearing and said cover passage.

9. A process for mixing the liquid contents of a tank without foaming and aeration comprising the steps of:

providing a tank having a bottom wall and a side wall extending upwardly from said bottom wall to an open upper end of said tank; and, providing an agitator assembly for mixing liquid contents of said tank, said agitator assembly comprising:

a shaft extending into said tank through said open upper end wherein a lower end of said shaft is disposed within said tank;

a paddle at said lower end of said shaft having first and second sides, a center region, a perimeter, and a plurality of passages extending from the first side to the second side, wherein the passages are disposed radially between locations proximate the center region and locations proximate the perimeter;

providing a motor coupled to an upper end of said shaft for reciprocating said paddle in said tank in directions generally along paths through said passages;

and reciprocating said paddle at a sufficiently slow reciprocation rate to substantially prevent foaming and aeration of the liquid contents in the tank.

10. The process of claim 9 including reciprocating said paddle along a generally linear path extending generally parallel to a longitudinal axis of said shaft.

11. The process of claim 9 wherein said perimeter of said paddle generally geometrically conforms to said side wall, the perimeter and the side wall defining a space therebetween.

12. The process of claim 9 wherein said tank side wall is cylindrical and said paddle has a circular perimeter of a diameter slightly less than an inside diameter of said tank side wall.

13. The process of claim 9 wherein said first and second sides of said paddle are generally planar.

14. The process of claim 9 wherein said first and second sides of said paddle have a generally semispherical profile.

15. The process of claim 14 wherein said first side is concave.

16. The process of claim 9 wherein said motor is an electric motor.

17. The process of claim 16 including coupling said motor to transmission means for converting a rotary output from said motor to a reciprocating output of said shaft.

18. The process of claim 17 including providing said transmission means with speed reduction means for converting the rotary output from said motor to a reduced speed output, providing a crank arm coupled to said speed reduction means and providing a connecting rod connecting said crank arm and said shaft to effect a reciprocating motion of said shaft and paddle.

19. The process of claim 16 wherein said motor is an a.c. induction motor, the process further including the step of providing an inverter for supplying to said induction motor an adjustable energizing voltage to control the rate of reciprocation of said paddle.

20. The process of claim 9 including providing said tank with a cover, having a passage and a linear bearing communicating with said cover passage, wherein said motor is supported on said cover and said shaft extends through said linear bearing and said cover passage.

* * * * *